US005995585A

United States Patent [19]

Salasoo

[11] Patent Number: 5,995,585

[45] Date of Patent: Nov. 30, 1999

[54] X-RAY TUBE HAVING ELECTRON COLLECTOR

[75] Inventor: Lembit Salasoo, Niskayuna, N.Y.

[73] Assignee: General Electric Company, Schenectady, N.Y.

[21] Appl. No.: 09/024,484

[22] Filed: Feb. 17, 1998

[51] Int. Cl.[6] ..... H01J 35/30

[52] U.S. Cl. ..... 378/137; 378/140

[58] Field of Search ..... 378/137, 140

[56] References Cited

U.S. PATENT DOCUMENTS

| | | | |
|---|---|---|---|
| 3,970,891 | 7/1976 | Heynisch et al. | 315/3.5 |
| 4,344,013 | 8/1982 | Ledley | 313/60 |
| 5,128,977 | 7/1992 | Danos | 378/121 |
| 5,689,542 | 11/1997 | Lavering et al. | 378/140 |

FOREIGN PATENT DOCUMENTS 0009946 4/1980 European Pat. Off. .

*Primary Examiner*—Craig E. Church

*Attorney, Agent, or Firm*—Douglas E. Erickson; Marvin Snyder

[57] ABSTRACT

An X-ray tube assembly having a cathode, an anode, and an electron collector surrounded by a vacuum-enclosing frame. Electrons from the cathode strike a focal point on the target surface of the anode. Some electrons produce X-rays which exit an X-ray-transparent window portion of the frame. Other electrons are backscattered and go on to strike and heat the frame. The electron collector preferably is positioned to intercept backscattered electrons which have the highest energy density trajectory of any electrons backscattered directly from the focal point that would otherwise strike the frame creating a thermal hot spot in the absence of the electron collector. Reducing or eliminating the thermal hot spot reduces or eliminates the heat that would otherwise be conducted to the window thereby minimizing tube failure.

11 Claims, 2 Drawing Sheets

X-RAY TUBE HAVING ELECTRON COLLECTOR

FIELD OF THE INVENTION

The present invention relates generally to X-ray tubes, and more particularly to an X-ray tube which includes an electron collector for capturing backscattered electrons.

BACKGROUND OF THE INVENTION

X-ray devices used in the medical field contain an X-ray tube which typically includes a cathode which is heated to emit electrons, a (typically rotating) anode having a target surface facing the cathode, and a surrounding glass and/or metal frame containing an X-ray-transparent window secured by a window mount. Some emitted electrons strike the target surface at a focal point and produce X-rays, and some of the X-rays exit the frame as an X-ray beam through the X-ray-transparent window. Other emitted electrons do not produce X-rays and are backscattered when they strike the focal point on the target surface.

Many of the backscattered electrons go on to strike and heat the frame including the X-ray-transparent window and the window mount. It is known to place an electron collector between the focal point and the X-ray-transparent window to capture backscattered electrons that would otherwise strike and heat the X-ray-transparent window, wherein the electron collector has a central hole to permit passage of the X-ray beam. The heated frame is typically cooled by a liquid coolant, such as oil or water, located between the frame and a surrounding casing. The dissimilar coefficients of thermal expansion of the X-ray-transparent window and the window mount generate mechanical stresses which can cause tube failure. Additionally, high temperatures in the X-ray-transparent window itself can induce boiling of the adjoining liquid coolant. Such coolant boiling will degrade the quality of the X-ray beam which exits the frame through the X-ray-transparent window. Existing grounded metal frame tubes include those having high-cost components to mechanically join the window to the rest of the frame while reducing thermal stresses to acceptable levels. Some known tubes have enhanced cooling applied to the window region.

It is also known that the backscattered electrons can create a thermal hot spot on the frame and can burn a hole through a glass frame. Such hot spot is located on the frame apart from the X-ray-transparent window and the window mount. Reducing the power of the X-ray beam and/or increasing cooling to the thermal hot spot region are known techniques used to overcome this problem.

What is needed is an improved X-ray tube design which reduces heating of the X-ray-transparent window and the window mount from backscattered electrons.

SUMMARY OF THE INVENTION

The X-ray tube assembly of the invention has an X-ray tube cathode, an X-ray tube anode, a generally-hermetically-sealed frame, and an electron collector. The cathode has a first electrical potential and includes an electron emitting surface having an electron beam axis. The anode is spaced apart from the cathode, has a second electrical potential which is more positive than the first electrical potential, and includes an X-ray target surface generally facing the electron emitting surface of the cathode and intersecting the electron beam axis at a focal point. The frame surrounds the cathode and the anode, is spaced apart from the electron emitting surface and the X-ray target surface, and includes an essentially-X-ray-transparent window having a point center of mass. The focal point and the point center of mass define an X-ray beam centerline. The X-ray beam centerline and the electron beam axis define a cutting plane of a cross section of the X-ray tube assembly. The electron collector is located within the frame, is spaced apart from the electron emitting surface, the X-ray target surface, the window, and the X-ray beam centerline, and has a third electrical potential which is more negative than the second electrical potential. When viewed in the cross section, the electron emitting surface has a location defined to be above the X-ray beam centerline, and the electron collector is located entirely above the X-ray beam centerline and entirely to one side of the cathode. Preferably, the electron collector is positioned to intercept, during operation of the X-ray tube assembly, backscattered electrons which have the highest energy density trajectory of any electrons backscattered directly from the focal point that would otherwise strike the frame creating a thermal hot spot in the absence of the electron collector.

Several benefits and advantages are derived from the invention. Positioning the electron collector to intercept the backscattered electrons which have the highest energy density trajectory of any electrons backscattered directly from the focal point that would otherwise strike the frame reduces or eliminates the thermal hot spot on the frame. Applicant surprisingly discovered that reducing or eliminating the thermal hot spot on the frame actually protects the window and the window mount from excessive heating that would otherwise occur due to heat conduction from the thermal hot spot to the window mount and window. Applicant also first discovered that thermally protecting the window by positioning an electron collector to reduce or eliminate the thermal hot spot on the frame was of more thermal benefit to the window, in many X-ray tube designs, than placing an electron collector between the focal point and the window.

DETAILED DESCRIPTION OF THE INVENTION

Figure 1:
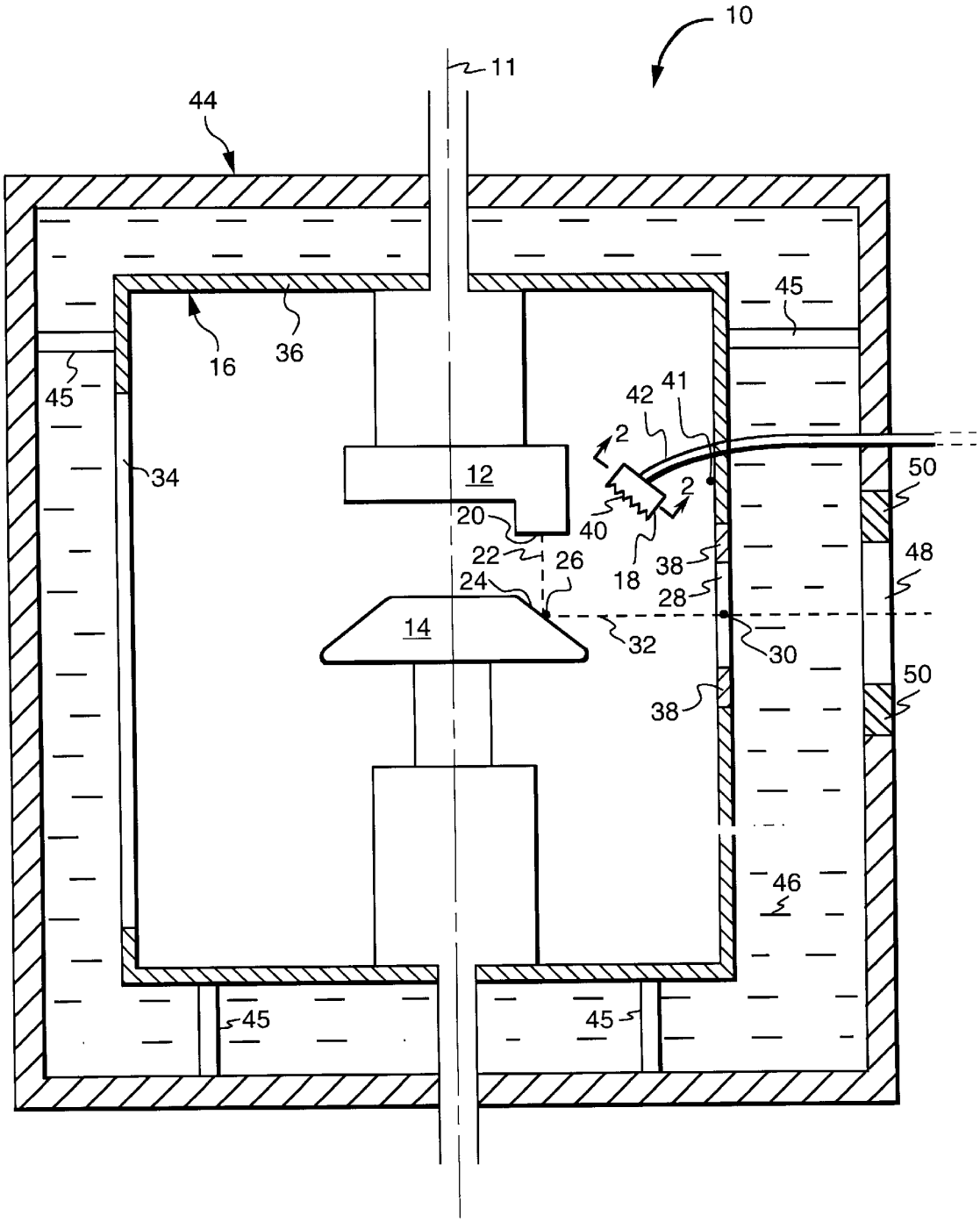
FIG. 1 is a schematic cross-sectional view of a preferred embodiment of the X-ray tube assembly of the present invention.

Referring now to the drawings, FIG. 1 schematically shows a preferred embodiment of the X-ray tube assembly 10 of the present invention. The X-ray tube assembly 10 has a tube axis 11 and includes an X-ray tube cathode 12, an X-ray tube anode 14, a generally-hermetically-sealed frame 16, and an electron collector 18. The cathode 12 has a first electrical potential and includes an electron emitting surface 20 having an electron beam axis 22. Preferably, the cathode 12 has a negative voltage of preferably between generally minus thirty kilovolts and generally minus eighty kilovolts.

The anode 14 is spaced apart from the cathode 12 and has a second electrical potential which is more positive than the first electrical potential. Preferably, the anode 14 has a positive voltage of preferably between generally plus thirty kilovolts and generally plus eighty kilovolts. The anode 14 includes an X-ray target surface 24 which generally faces the electron emitting surface 20 of the cathode 12 and which intersects the electron beam axis 22 at a focal point 26. Typically, the electron beam axis 22 makes an eighty to ninety degree angle with the X-ray target surface 24, but such angle can be reduced to a low value to concentrate the direction of the backscattered electrons away from the hereinafter-described X-ray-transparent window 28.

The frame 16, which acts as a vacuum enclosure, surrounds the cathode 12 and the anode 14 and is spaced apart from the electron emitting surface 20 of the cathode 12 and the X-ray target surface 24 of the anode 14. The frame 16 includes an essentially-X-ray-transparent window 28 which has a point center of mass 30. The focal point 26 and the point center of mass 30 define an X-ray beam centerline 32. The X-ray beam centerline 32 and the electron beam axis 22 define a cutting plane of a cross section (i.e., the cross section depicted in FIG. 1) of the X-ray tube assembly 10. The choice of material for the frame 16 is left to the artisan. For example, and without limitation, the frame 16 may consist essentially of glass or may consist essentially of metal. The frame 16 may also have a glass section 34 and a metal section 36 as shown in FIG. 1. The X-ray-transparent window 28 may, without limitation, comprise, or consist essentially of, glass or metal as is known to those skilled in the art. For a metal frame, a preferred bulk frame material is copper or steel, and for the X-ray-transparent window portion, a preferred material is beryllium. The frame 16 also includes a window mount 38 securing the X-ray-transparent window 28. The window mount 38 likewise may, without limitation, comprise, or consist essentially of, glass or metal as is known to those skilled in the art. It s noted that a glass window mount is an area of the frame which transitions from the glass used for the non-window portion of the frame to the glass used for the window portion of the frame.

The electron collector 18 is disposed within the frame 16 and is spaced apart from the electron emitting surface 20, the X-ray target surface 24, the X-ray-transparent window 28, and the X-ray beam centerline 32. The electron collector 18 has a third electrical potential which is more positive than the first electrical potential of the cathode 12 (and preferably more positive than the second electrical potential of the anode 14). Preferably, the electron collector 18 has a positive electrical potential. When viewed in the cross section defined in the previous paragraph and depicted in FIG. 1, the electron emitting surface 20 of the cathode 12 has a location defined to be above the X-ray beam centerline 32, and the electron collector 18 is located entirely above the X-ray beam centerline 32 and entirely to one side of the cathode 12. In an exemplary construction, the electron collector 18 has an electron-collecting surface 40 comprising, and preferably consisting essentially of, a material having a low atomic number, such as carbon or beryllium. The material of the surface 40 may be a CVD (chemical vapor deposition) layer or other coating, or the entire electron collector 18, including its surface 40, may define a monolithic component comprising, and preferably consisting essentially of, the same low atomic number material.

When viewed in the previously-defined cross section (depicted in FIG. 1), preferably the electron collector 18 is located entirely above a line drawn between the focal point 26 and a point on the X-ray-transparent window 28 furthest above the X-ray beam centerline 32. So located, the electron collector 18 is placed out of the line of sight from the focal point 26 to any point on the X-ray-transparent window 28 so as not to degrade the quality of the X-ray beam exiting the X-ray-transparent window 28. In an exemplary arrangement, the electron collector 18 has a projection onto the X-ray beam centerline 32 which falls completely between the focal point 26 and the point center of mass 30.

In an exemplary enablement, the electron collector 18 is positioned to intercept, during operation of the X-ray tube assembly 10, backscattered electrons which have the highest energy density trajectory of any electrons backscattered directly from the focal point 26 that would otherwise strike the frame 16 creating a thermal hot spot 41 in the absence of the electron collector 18. The trajectories of the backscattered electrons, the energy density of those trajectories, the identification of the highest energy density trajectory, the location of the thermal hot spot 41 on the frame 16, and the placement of the electron collector 18 so as to intercept the highest energy density trajectory, are all within the level of skill of the artisan employing known electrical field analysis using conventional computer simulation techniques. Positioning the electron collector 18 to intercept the backscattered electrons which have the highest energy density trajectory of any electrons backscattered directly from the focal point 26 that would otherwise strike the frame 16 reduces or eliminates the thermal hot spot 41 on the frame 16. It is noted that such thermal hot spot is located apart from the X-ray-transparent window 28 and the window mount 38. Applicant surprisingly found that reducing or eliminating the thermal hot spot 41 on the frame 16 actually protects the X-ray-transparent window 28 and the window mount 38 from excessive heating that would otherwise occur due to heat conduction from the thermal hot spot 41 to the window mount 38 and the X-ray-transparent window 28. Applicant also found that thermally protecting the X-ray-transparent window 28 by positioning the electron collector 18 to reduce or eliminate the thermal hot spot 41 on the frame 16 was of more thermal benefit to the X-ray-transparent window 28, in many X-ray tube designs, than placing an electron collector between the focal point 26 and the window 28. Although additional electron collectors may be added in a particular tube design, it is preferred that the electron collector 18 be the only collector of electrons backscattered directly from the focal point 26 which is disposed within the frame 16 and which is spaced apart from the anode 14 and the frame 16.

Preferably, the electron collector 18 is mechanically supported by an arm 42 which also contains, or acts as, an electrical lead. The arm 42 is attached to the frame 16. Such attachment is a dielectric attachment when the frame 16 has a different electrical potential than the arm 42 in the vicinity of the attachment. Preferably, the electron collector 18 is disposed closer to the point center of mass 30 of the X-ray-transparent window 28 than to the focal point 26 on the anode 14. Such location permits the electron collector 18 to intercept the trajectories of more backscattered electrons. Of course, a sufficient electrical standoff distance must be maintained between the electron collector 18 and other different electrically-charged components such as, but not limited to, the cathode 12, to keep tube sparking, during operation of the X-ray tube assembly 10, to an acceptably low value, as can be appreciated by those skilled in the art. Preferably, the electron collector 18 is connected to an electrical circuit that maintains the required electron collector voltage potential and also returns the intercepted backscattered electron current to the X-ray beam power supply (such electrical circuit and power supply being conventional and omitted from the figures).

In a preferred construction, the X-ray tube assembly 10 moreover includes a casing 44 which surrounds and is generally spaced apart from the frame 16 by dielectric spacers 45. A liquid coolant 46, such as oil or water, is disposed between the frame 16 and the casing 44. The casing 44 includes an essentially-X-ray-transparent window 48 and a window mount 50. The casing 44 typically is an X-ray-shielding metal casing except for its X-ray-transparent window 48.

Figure 2:
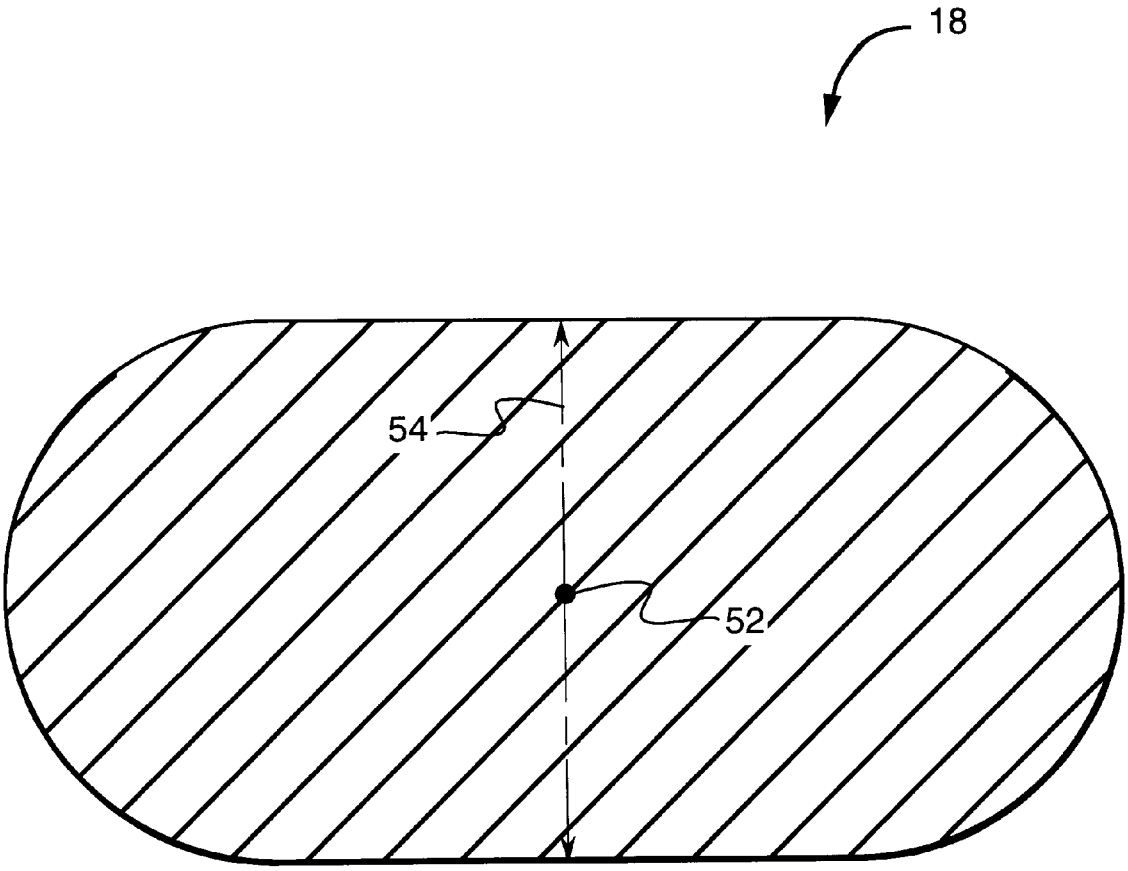
FIG. 2 is a view of the electron collector of the X-ray tube assembly of FIG. 1 taken along lines 2—2 of FIG. 1.

In an exemplary enablement, the electron collector 18 has a generally elliptical shape, when viewed from the focal point 26, having a center 52, as shown in FIG. 2. Preferably, the center 52 lies generally in the previously-defined cutting plane (i.e., the cutting plane defined by the X-ray beam centerline 32 and the electron beam axis 22). In a preferred design, the elliptical shape has a minor axis 54 which also lies in the previously-defined cutting plane. The electron-collecting surface 40 of the electron collector 18 faces generally towards the focal point 26. The electron-collecting surface 40 is a textured surface which is defined to be a surface intentionally roughened for the purpose of trapping backscattered electrons impinging thereon. The electron-collecting surface 40 may roughened by giving it a sawtooth surface profile (as shown in FIG. 1), by knurling, by pitting, or by grooving, and the like, as can be appreciated by the artisan.

As previously mentioned, the frame 16 includes a window mount 38 securing the X-ray-transparent window 28. Preferably, the window mount 38 is an electrically-insulated window mount. Here, the frame 16, apart from the X-ray-transparent window 28 and the window mount 38, has a fourth electrical potential proximate the window mount 38. The X-ray-transparent window 28 has a fifth electrical potential, and the fifth electrical potential is more negative than the fourth electrical potential. From here, one option is to have the fourth electrical potential be equal to generally the second electrical potential. This means that the frame 16 (or at least its metal portion 36) has the same electrical potential as the anode 14 which eliminates the need to electrically insulate these components from each other. In another option, the fourth electrical potential is more negative than the second electrical potential.

The foregoing description of several preferred embodiments of the invention has been presented for purposes of illustration. It is not intended to be exhaustive or to limit the invention to the precise form disclosed, and obviously many modifications and variations are possible in light of the above teaching. It is intended that the scope of the invention be defined by the claims appended hereto.

What is claimed is:

1. An X-ray tube assembly comprising:

a) an X-ray tube cathode having a first electrical potential and including an electron emitting surface having an electron beam axis;

b) an X-ray tube anode spaced apart from said cathode, having a second electrical potential which is more positive than said first electrical potential, and including an X-ray target surface generally facing said electron emitting surface of said cathode and intersecting said electron beam axis at a focal point;

c) a generally-hermetically-sealed frame surrounding said cathode and said anode, spaced apart from said electron emitting surface and said X-ray target surface, and including an essentially-X-ray-transparent window having a point center of mass, wherein said focal point and said point center of mass define an X-ray beam centerline, and wherein said X-ray beam centerline and said electron beam axis define a cutting plane of a cross section of said X-ray tube assembly; and d) an electron collector disposed within said frame, spaced apart from said electron emitting surface, said X-ray target surface, said window, and said X-ray beam centerline, and having a third electrical potential which is more positive than said first electrical potential, wherein, when viewed in said cross section, said electron emitting surface has a location defined to be above said X-ray beam centerline and said electron collector is located entirely above said X-ray beam centerline and entirely to one side of said cathode.

2. The X-ray tube assembly of claim 1, wherein, when viewed in said cross section, said electron collector is located entirely above a line drawn between said focal point and a point on said window furthest above said X-ray beam centerline.

3. The X-ray tube assembly of claim 2, wherein said electron collector has a projection onto said X-ray beam centerline which falls completely between said focal point and said point center of mass.

4. The X-ray tube assembly of claim 3, wherein said electron collector is positioned to intercept, during operation of said X-ray tube assembly, backscattered electrons which have the highest energy density trajectory of any electrons backscattered directly from said focal point that would otherwise strike said frame creating a thermal hot spot in the absence of said electron collector.

5. The X-ray tube assembly of claim 4, wherein said projection is disposed closer to said point center of mass than to said focal point.

6. The X-ray tube assembly of claim 5, wherein said electron collector has a generally elliptical shape, when viewed from said focal point, wherein said elliptical shape has a center, and wherein said center lies generally in said cutting plane.

7. The X-ray tube assembly of claim 6, wherein said elliptical shape has a minor axis which lies generally in said cutting plane.

8. The X-ray tube assembly of claim 7, wherein said electron collector has an electron-collecting surface facing generally towards said focal point, and wherein said electron-collecting surface is a textured surface.

9. The X-ray tube assembly of claim 8, wherein said frame also includes an electrically-insulated window mount securing said window, wherein said frame, apart from said window and said window mount, has a fourth electrical potential proximate said window mount, wherein said window has a fifth electrical potential, and wherein said fifth electrical potential is more negative than said fourth electrical potential.

10. The X-ray tube assembly of claim 9, wherein said fourth electrical potential is equal to generally said second electrical potential.

11. The X-ray tube assembly of claim 9, wherein said fourth electrical potential is more negative than said second electrical potential.

* * * * *